US005667364A

United States Patent [19]

O Mara et al.

[11] Patent Number: 5,667,364

[45] Date of Patent: Sep. 16, 1997

[54] DOWNHOLE HYDRAULIC PUMP APPARATUS HAVING A "FREE" JET PUMP AND SAFETY VALVE ASSEMBLY AND METHOD

[75] Inventors: David P. O Mara, Canyon Country, Calif.; Arron C. Hinds, Webster, Tex.

[73] Assignee: Trico Industries, Inc., San Marcos, Tex.

[21] Appl. No.: 362,242

[22] Filed: Dec. 22, 1994

(Under 37 CFR 1.47)

Related U.S. Application Data

[63] Continuation-in-part of Ser. No. 308,600, Sep. 19, 1994, abandoned.

[51] Int. Cl.[6] ..... F04F 5/00

[52] U.S. Cl. ..... 417/151; 417/172; 417/190; 166/332.8

[58] Field of Search ..... 417/151, 172, 417/183, 190; 166/332.8, 372, 373

[56] References Cited

U.S. PATENT DOCUMENTS

| | | | |
|---|---|---|---|
| 1,355,606 | 10/1920 | Ingram . | |
| 1,758,376 | 5/1930 | Sawyer . | |
| 2,178,309 | 10/1939 | Oldham | 417/190 |
| 2,287,076 | 6/1942 | Zachry . | |
| 2,368,428 | 1/1945 | Saurenman | 166/332.8 |
| 2,826,994 | 3/1958 | Slater . | |
| 2,971,581 | 2/1961 | Reglin | 166/332.8 |
| 3,215,087 | 11/1965 | McLeod . | |
| 3,887,008 | 6/1975 | Canfield . | |
| 4,171,016 | 10/1979 | Kempton . | |
| 4,183,722 | 1/1980 | Roeder . | |
| 4,293,283 | 10/1981 | Roeder . | |
| 4,390,061 | 6/1983 | Short . | |
| 4,440,231 | 4/1984 | Martin | 166/332.8 |
| 4,603,735 | 8/1986 | Black . | |
| 4,658,893 | 4/1987 | Black . | |
| 4,723,890 | 2/1988 | Corteville et al. . | |
| 4,753,577 | 6/1988 | Black et al. | 417/172 |
| 4,790,376 | 12/1988 | Weeks . | |
| 4,844,166 | 7/1989 | Going, III et al. . | |
| 5,055,002 | 10/1991 | Roeder | 417/172 |
| 5,083,609 | 1/1992 | Coleman . | |
| 5,472,054 | 12/1995 | Hinds | 166/373 |

OTHER PUBLICATIONS

Trico Industries, Inc., 1994–95 Catalog, "Taking Care of Business".

*Primary Examiner*—Timothy Thorpe
*Assistant Examiner*—Ted Kim
*Attorney, Agent, or Firm*—Pravel, Hewitt, Kimball & Krieger

[57] ABSTRACT

A downhole hydraulic pump apparatus for a well assembly including a rigid, elongated production tubing extending into a formation producing production fluid. The hydraulic pump apparatus includes an elongated tube and a bottom-hole assembly mounted to a lower end of the elongated tube. The bottom-hole assembly includes an upper assembly connected to a middle assembly connected to a lower assembly. The upper assembly has an upper bore therethrough. The middle assembly has a middle longitudinal bore therethrough, a fluid longitudinal port therethrough and a discharge port. The lower assembly has a lower bore and a safety valve therein. A pump assembly is formed for sliding receipt in the elongated tube. The pump assembly includes an upper pump body formed for sliding receipt in the upper assembly and a lower extension assembly connected to the upper pump body. The lower extension assembly has a first portion and a second portion. The first portion is formed to open the safety valve upon the seating of the pump assembly in the bottom-hole assembly. The second portion has an extension discharge port formed to be in fluid communication with the discharge port of the middle assembly upon the seating of the pump assembly in the bottom-hole assembly.

14 Claims, 4 Drawing Sheets

DOWNHOLE HYDRAULIC PUMP APPARATUS HAVING A "FREE" JET PUMP AND SAFETY VALVE ASSEMBLY AND METHOD

REFERENCE TO RELATED APPLICATION

This Application is a continuation-in-part of U.S. patent application Ser. No. 08/308,600, filed Sep. 19, 1994, abandoned, for A "FREE" COIL TUBING DOWNHOLE JET PUMP APPARATUS AND METHOD. The inventors listed in the present application are the named inventors in application Ser. No. 08/308,600, now abandoned.

BACKGROUND OF THE INVENTION

1. Field of the Invention

The present invention relates, generally, to "free" downhole hydraulic pump assemblies, and more particularly, relates to "free" jet pump assemblies deployed through coiled tubing and jointed tubing to a bottom-hole assembly.

2. Description of the Prior Art

As the demand for natural oil and gas increases, so does the need for efficient retrieval of these limited resources from their subterranean locations. This is especially apparent in economies where the price per barrel of crude oil not infrequently fails to proportionately rise with increased demand. Hence, through an abundance of research and development, the techniques and equipment employed to remove these formation or production fluids have become increasingly sophisticated and efficient.

In a typical oil and gas recovery process, after a well has been drilled, a steel tubular casing, extending the length of the well, is inserted into the well and uncured concrete is pumped down the casing. Upon forcing of the concrete out of the bottom of the casing, it fills an annular space between an outer surface of the casing and formation walls of the well, where the concrete cures to firmly anchor the casing to the well walls and seal off the well. To access the formation fluids through the now sealed well casing, both the casing and the concrete are perforated at a predetermined downhole location below the formation fluid level (and a slurry plug in the casing). These perforations allow the production fluid to enter the well casing from the formation for retrieval. Due to the difference in pressure between the formation and the well casing interior, the inrush of the fluid into the well is substantial enough to clean the perforation passages of any debris for unobstructed passage of production fluid into the casing.

In some regions, such as in the Middle East, sufficient bottom hole pressure, via natural gas, often is available in the formation to force the production fluid to the surface, where it can be collected and utilized for commercial purposes. As the localized natural gas in these drilled formations begin to deplete, gas lifting techniques and associated apparatus are employed which inject gas into the production fluids to assist lifting of them to the surface. This gas injection typically involves inserting a smaller diameter jointed gas lift tube into the well casing. The gas lift tube includes a plurality of perforated gas lift mandrels formed for discharging gas. As the gas passes through the mandrels and into the production fluid in the annulus formed between the casing and the jointed tube, the gas mixes with, and is entrained in the production fluid, causing the density, and hence the column fluid weight or gradient, to decrease. This lower weight enables the current, lower, down-hole pressure to lift the production fluids to the surface for collection.

In time, however, water seeps into or permeates the well column, which eventually impedes or prevents removal of the production fluids through gas lifting techniques. Traditionally, water is removed by purging the well with nitrogen. Purging is typically performed by inserting coil tubing into the jointed gas lift tube which coil tubing includes a one-way valve situated at the lower or distal end thereof. Nitrogen gas is discharged through the valve which exits the coil tubing at a sufficient pressure and rate to purge the undesirable water from the annulus. This purge permits the formation or production fluids to enter the annulus through the casing perforations for lifting to the surface.

While this technique has proven sufficient to remove water from the well column, the costs associated with operation can escalate. This is primarily due to the amount of nitrogen gas which must be discharged from the coil tubing, which is substantial. Other gases may be employed for purging but nitrogen is inert and available.

In some instances, a more cost-effective approach than the use of nitrogen purging can be used. A hydraulic or down-hole jet pump can be lowered into the well casing to pump water and/or production fluid from the column. Due to the small diameter tubing of some gas lift installations, however, a small diameter jet pump would be required to be inserted into the gas lift tube. Such pumps are not widely available. Larger diameter jet pumps could be deployed by removing the gas lift tubing, but this approach is impractical due to cost of removal and re-deployment of the gas lift tubing.

Hydraulic or down-hole jet pumps are often favored over mechanical-type pumps in situations such as de-watering of wells or production fluid pumping. Briefly, jet pumps generally include a power fluid line operably coupled to the entrance of the jet pump, and a return line coupled to receive fluids from a discharge end of the pump. As the pressurized power fluid is forced, by a pump at the surface, down through the down-hole jet pump, the power fluid draws in and intermixes with the production fluid. The power fluid and production fluid then are pumped to the surface through the return line, and the production fluid may then be recovered, together with the power fluid. Jet pumps are often advantageous since they generally involve substantially less moving parts than mechanical pumps, which increases their reliability. Typical of patented jet pumps are the pumps disclosed in U.S. Pat. Nos. 1,355,606; 1,758,376; 2,287,076; 2,826,994; 3,215,087; 3,887,008; 4,183,722; 4,293,283; 4,390,061; 4,603,735; and 4,790,376.

Recent developments, however, have favored the use of "free" jet pumps which enable removal of the jet pump body while retaining substantial portions of the coil tubing or jointed tubing intact in the well. The jet pump body can be installed for operation by pumping the jet pump body down the tubing, and it may be removed by reversing the flow of the power fluid. Hence, the "free" jet pump body may be adjusted, and/or replaced without requiring that the tubing be pulled from the well. Typical of these "free" jet pumps are the pumps disclosed in U.S. Pat. Nos. 4,658,693 and 5,083,609.

FIG. 1 illustrates a prior art high volume, "free" hydraulic jet pump 10 retrievable by reverse flow. Briefly, a coiled or jointed tubing 11 is deployed in a well casing 12 formed to slidably receive a jet pump body 13 in column 14. A bottom-hole assembly 15 is mounted to a lower end of tubing 11, which is secured to well casing 12 through a packer 16 to seal casing column 14. In operation, after passage down through tubing 11, jet pump body 13 is formed to slidably seat in a vertical cavity 17 provided in bottom-hole assembly 15. A standing valve 18, situated at a lower end of jet pump 10, permits passage of production fluid therethrough into a bottom hole annulus 20 formed between the pump body 13 and the walls forming the vertical cavity 17. As the pressurized power fluid in tubing 11 is forced through a jet pump nozzle 22, it intermixes with the production fluid through entrances 23 and is injected through diffuser 24 and discharged out port 25 into well casing annulus 26 for passage upwardly to the surface and retrieval.

As mentioned, these jet pumps are relatively low maintenance partially due to their lack of moving parts. One area of weakness or region of failure, however, is the O-ring or fluid seals 27, 27', 27" and 27'" carried by pump body 13 which seals cooperate with the pump body 13 and the bottom-hole assembly housing to separate the individual intake and discharge compartments. As illustrated in the jet pump 10 of FIG. 1, at least four O-ring seals 27, 27', 27" and 27'" are provided which form a fluid-tight seal against the interior wall 28 forming bottom-hole assembly vertical cavity 17. These fluid seals 27, 27', 27" and 27'", separating the adjacent compartments, must be of sufficient integrity to withstand the high pressures generated by the power fluid and the discharged production fluids.

This integrity, however, is sometimes compromised as the outward facing orientation of the fluid seals 27, 27', 27" and 27'" expose them to contact with the interior walls 29 of the tubing 11 as the jet pump 10 passes therethrough. Moreover, as the jet pump 10 seats in the vertical cavity 17 of bottom-hole assembly 15 to separate the intake and discharge compartments, the three bottommost O-ring seals 27, 27' and 27" must traverse at least one, and as many as three, other seal points 30', 30" and 30'" before forming a seal with the corresponding seal wall. For example, O-ring seal 27 must traverse seal points 30'", 30" and 30' before forming a seal with the corresponding seal wall 30. This sliding contact degrades the seal integrity which may cause leakage in time. This, of course, results in pump down-time, as well as, maintenance at more frequent intervals.

Applicants' pending U.S. patent application Ser. No. 308,600, filed Sep. 19, 1994, for A "FREE" COIL TUBING DOWNHOLE JET PUMP APPARATUS AND METHOD discloses a downhole hydraulic pump apparatus which minimizes the number of O-ring or fluid seal contacts required during installation and removal of a "free" jet pump assembly. Applicants hereby incorporate by reference the entire specification of parent application Ser. No. 308,600.

Environmental considerations and regulations require that a downhole safety valve be installed in offshore production operations. In the past, the only way to utilize the downhole safety valve with a "free" jet pump was to include hydraulic lines running from the surface down to the safety valve. The safety valve was then controlled from the surface by hydraulic controls.

It is desirable to have a downhole hydraulic pump apparatus including a "free" jet pump apparatus and a downhole safety valve which can be operated without hydraulic controls at the surface. It is further desirable to have a downhole hydraulic pump apparatus having a downhole safety valve which is mechanically opened by a "free" jet pump assembly. It is further desirable to have a downhole hydraulic pump apparatus having a downhole safety valve which will automatically close upon a loss of surface communication.

SUMMARY OF THE INVENTION

The present invention is a downhole hydraulic pump apparatus including a "free" jet pump assembly and a downhole safety valve. The downhole safety valve is operable without surface controls. The downhole safety valve is mechanically opened by a "free" jet pump assembly.

The downhole hydraulic pump apparatus of the present invention operates in a well assembly including a rigid, elongated tubular casing extending into a formation producing production fluid. The hydraulic pump apparatus includes an elongated tube and a bottom-hole assembly mounted to a lower end of the elongated tube.

The bottom-hole assembly includes an upper assembly connected to a middle assembly connected to a lower assembly. The upper assembly has an upper bore therethrough. The middle assembly has a middle longitudinal bore therethrough, a fluid longitudinal port therethrough and a discharge port. The lower assembly has a lower bore and a safety valve therein.

A pump assembly is formed for sliding receipt in the elongated tube. The pump assembly includes an upper pump body formed for sliding receipt in the upper assembly and a lower extension assembly connected to the upper pump body. The lower extension assembly has a first portion and a second portion. The first portion is formed to open the safety valve upon the seating of the pump assembly in the bottom-hole assembly. The second portion has an extension discharge port formed to be in fluid communication with the discharge port of the middle assembly upon the seating of the pump assembly in the bottom-hole assembly.

The-hydraulic pump apparatus and method can be installed downhole with coiled tubing. The hydraulic pump apparatus has a small diameter and is employable in existing gas lift wells, flowing wells, and non-flowing wells with minimal alteration. The present invention reduces the costs of de-watering a well. The hydraulic pump apparatus is durable, compact, easy to maintain, and has a minimum number of components.

BRIEF DESCRIPTION OF THE DRAWINGS

The assembly of the present invention has other objects and features of advantage which will be more readily apparent from the following Detailed Description of the Invention and the appended claims, when taken in conjunction with the accompanying drawings, in which:

DETAILED DESCRIPTION OF THE INVENTION

Figure 1:
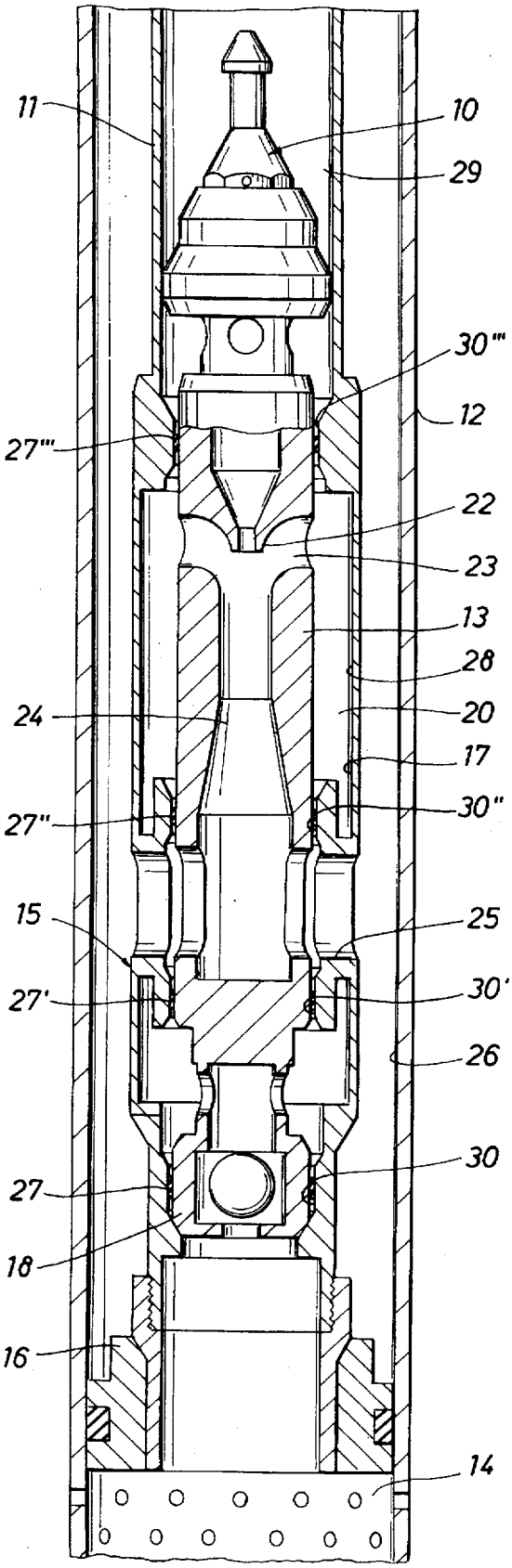
FIG. 1 (PRIOR ART)
FIG. 1 is a fragmentary, side elevation view, partially broken away, of a prior art high volume "free" jet pump installed in a well casing.

While the present invention will be described with reference to a few specific embodiments, the description is illustrative of the invention and is not to be construed as limiting the invention. Various modifications to the present invention can be made to the preferred embodiments by those skilled in the art without departing from the true spirit and scope of the invention as defined by the appended claims. It will be noted here that for a better understanding, like components are designated by like reference numerals throughout the various figures.

Figure 2:
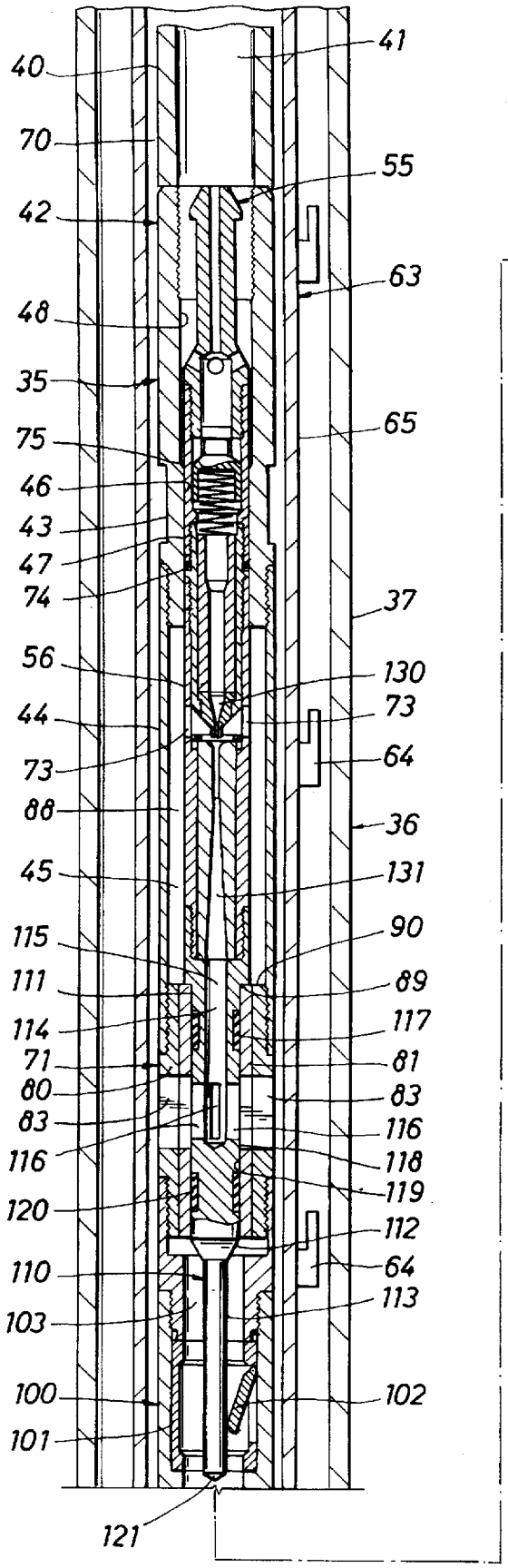
FIG. 2 is a fragmentary, side elevation view, in cross-section, of the hydraulic pump apparatus constructed in accordance with the present invention.
Figure 2:
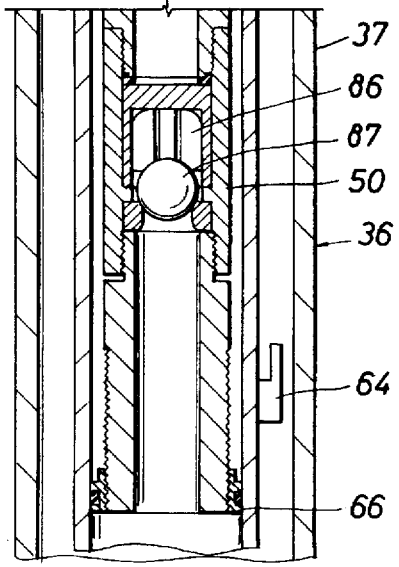
Figure 3:
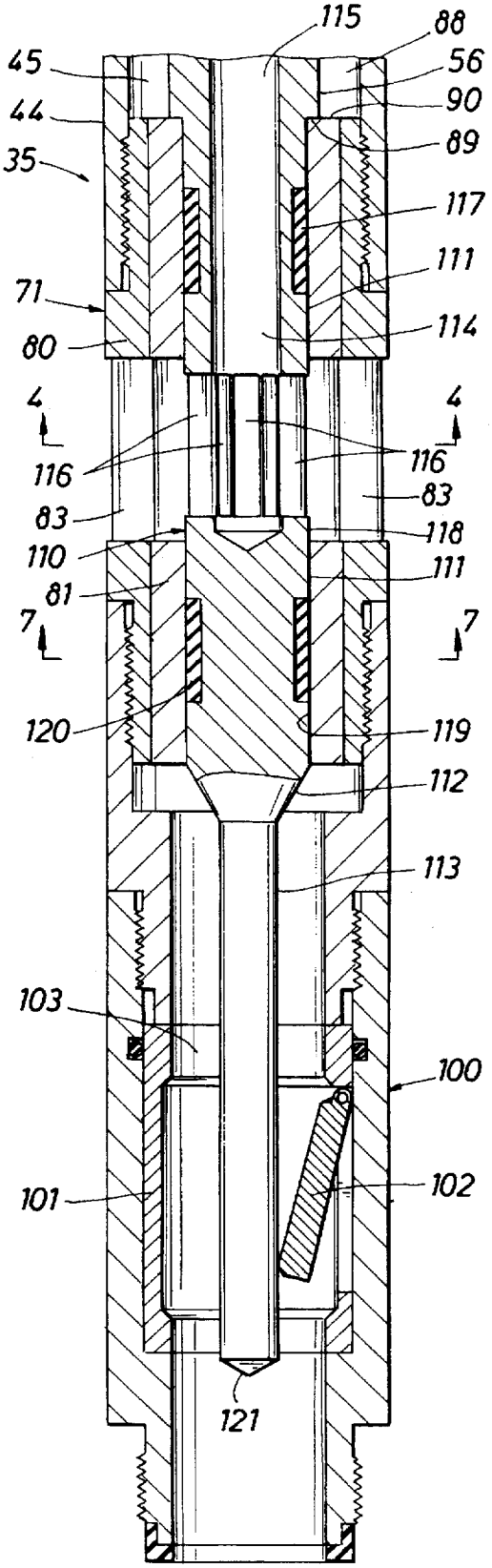
FIG. 3 is an enlarged, fragmentary side elevation view, in cross-section, of the lower portion of the jet pump apparatus of FIG. 2.
Figure 4:
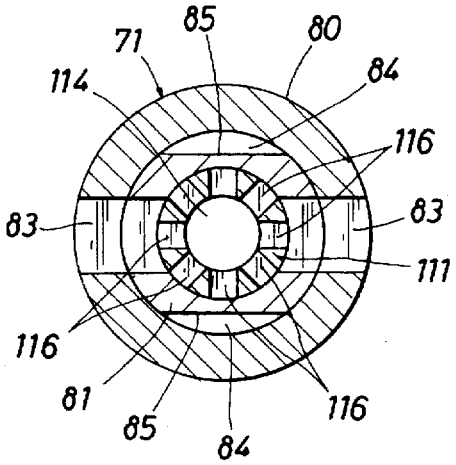
FIG. 4 is a view taken along line 4—4 of FIG. 3.
Figure 5:
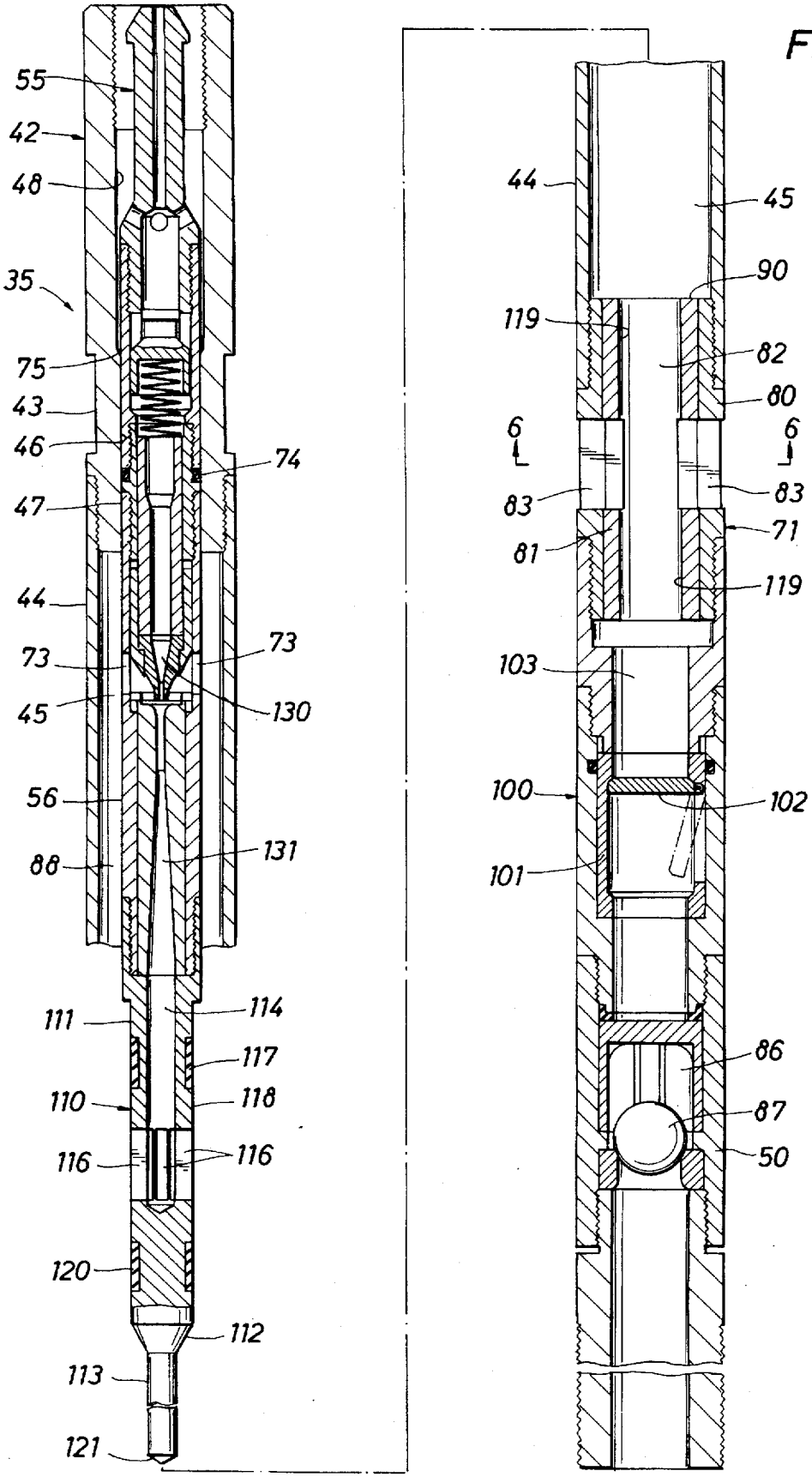
FIG. 5 is a fragmentary side elevation view, in cross-section, of the hydraulic pump apparatus of FIG. 2 illustrating the "free" jet pump assembly engaged in the upper portion of the bottom-hole assembly with the lower portion of the bottom-hole assembly broken away for clarity purposes.

FIGS. 2–7 illustrate the present hydraulic pump apparatus, generally designated 35, which is formed to be employed in a well completion or assembly 36 (FIG. 2) including a rigid, elongated production tubing 37 extending into a formation containing a production fluid. Referring to FIG. 2, hydraulic jet pump apparatus 35 includes an elongated tube 40 adapted for selective insertion into production tubing 37. Elongated tube 40 has a longitudinal passageway 41 extending therethrough. A bottom-hole assembly, generally designated 42, is mounted to a lower end of tube 40. FIGS. 2 and 5 illustrate that bottom-hole assembly 42 includes an adapter housing 43 with a downwardly extending outer tubular member 44 mounted thereto and forming a lower vertical cavity 45. Housing 43 forms a sealing bore portion 47 provided by an upper interior surface 48, and a lower inwardly facing sealing surface 46. Sealing bore portion 47 provides communication between tube passageway 41 and lower vertical cavity 45.

Figure 6:
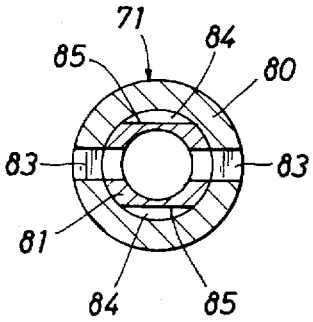
FIG. 6 is a view taken along line 6—6 of FIG. 5.

Referring to FIGS. 2, 3 and 5, a lower end of the outer tubular member 44 is connected to a middle plug assembly 71. Middle plug assembly 71 includes an outer middle plug member 80 and a middle plug insert 81 which is inserted in the outer middle plug member 80. Preferably, the middle plug insert 81 is securably connected to the outer middle plug member 80, as for example by welding. The middle plug insert 81 has a longitudinal port 82 extending through the middle plug assembly 71. The middle plug assembly 71 further includes a pair of discharge ports 83 which intersect, preferably transversely, with the longitudinal port 82. Referring to FIGS. 5 and 6, the pair of discharge ports 83 diametrically oppose each other and are co-axial with one another in the preferred embodiment of the invention. It is to be understood that the preferred embodiment of the present invention includes a pair of discharge ports 83 but one or more discharge ports 83 could be included without departing from the true spirit and nature of the present invention.

Figure 7:
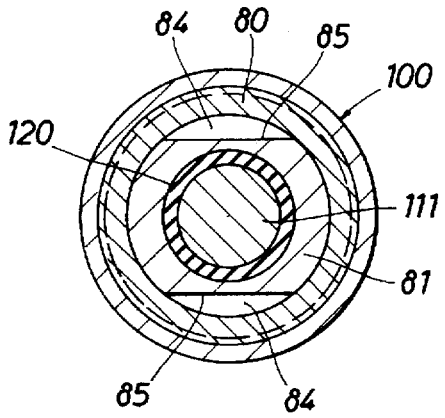
FIG. 7 is a view taken along line 7—7 of FIG. 3.

In the preferred embodiment, a pair of suction ports 84 are formed in middle plug assembly 71 as shown in FIGS. 4, 6 and 7. Suction ports 84 extend through middle plug assembly 71. Preferably, suction ports 84 are formed by cutting or machining a pair of oppositely positioned flat surfaces 85 on the exterior surface of middle plug insert 81. Once the flat surfaces 85 have been formed, the middle plug insert 81 is inserted in the outer middle plug member 80 and weldably secured thereto. The discharge ports 83 are then formed in the middle plug assembly 71. The discharge ports 83 do not intersect with the flat surfaces 85. It is to be understood that the pair of discharge ports 83 do not come into contact with the pair of suction ports 84 within middle plug assembly 71 for reasons which will be explained below. It is to be understood that the preferred embodiment of the present invention includes a pair of suction ports 84 but one or more suction ports 84 could be included without departing from the true spirit and nature of the present invention.

Referring to FIGS. 2, 3 and 5, a safety valve assembly 100 is connected to the lower end of the middle plug assembly 71. Preferably, the safety valve assembly 100 comprises a flapper valve 101 having a valve bore 103 and a spring-biased, hinged-connected flapper 102 which may rotate through an angle of approximately 90 degrees. As shown in FIG. 5, the flapper 102 is normally spring-biased to the closed position. Downhole flapper valves 101 are well known in the art and are commercially available. Flapper valve bore 103 is in communication with longitudinal port 82 and the pair of suction ports 84 of middle plug assembly 71.

Referring to FIGS. 2 and 5, a standing valve 50 is situated at a lower end of safety valve assembly 100 of bottom-hole assembly 42. Standing valve 50 includes a standing valve passageway 86 which is opened or closed by a valve ball 87. Standing valve passageway 86 initially receives the production fluid prior to being pumped to the surface.

Referring to FIGS. 2 and 5, a "free" jet pump assembly, generally designated 55, is included which is formed for sliding receipt in tube passageway 41. Jet pump assembly 55 is also formed for sliding receipt in bottom-hole assembly 42 as will be explained below. Jet pump assembly 55 includes an elongated pump body 56 which is formed to extend into lower vertical cavity 45 to form a pump annulus 88 between elongated pump body 56 and downwardly extending outer tubular member 44 of bottom-hole assembly 42 as the jet pump assembly 55 is moved into the operating production position as shown in FIG. 2.

As shown in FIGS. 2, 3 and 5, jet pump assembly 55 includes a downwardly-facing shoulder 89 which seats against an upwardly-facing end surface 90 of middle plug assembly 71 when jet pump assembly 55 is seated in operating production position.

Referring to FIGS. 2 and 5, at least one upper seal 74 is situated between an exterior surface of jet pump body 56 and inwardly facing sealing bore portion 47 of adapter housing 43. Upper seal 74, preferably an O-ring, forms a fluid-tight seal separating vertical cavity 45 from tube passageway 41 at a location above vertical cavity 45. FIGS. 2 and 5 illustrate that a lower portion of upper interior surface 48 of adapter housing 43 includes a tapered shoulder portion 75 tapering inwardly to join sealing surface 46. Sealing surface 46 has a diameter sufficient to compress upper seal 74 to form a fluid-tight seal between pump body 56 and sealing surface 46. Hence, as pump body 56 slides into sealing bore portion 47, upper O-ring seal 74, retained in an annular groove in pump body 56, slidably engages tapered shoulder portion 75 compressing upper O-ring seal 74 to separate vertical cavity 45 from tube passageway 41. It will be understood that a multiple or series of side-by-side upper O-rings 74 could be included without departing from the true spirit and nature of the present invention to separate the adjoining tube passageway 41 and vertical cavity 45.

Referring to FIGS. 2, 3 and 5, a pump discharge port extension assembly, generally designated 110, is positioned at a lower end of pump body 56. Pump discharge port extension assembly 110 includes an upper cylindrical portion 111 which joins a tapered shoulder midportion 112 tapering inwardly to join a lower stinger 113.

As shown in FIGS. 2 and 3, stinger 113 forces and maintains flapper 102 open when the jet pump assembly 55 is seated in bottom-hole assembly 42. Upon retrieval or unseating of jet pump assembly 55 from bottom-hole assembly 42, flapper 102 moves to the closed position (FIG. 5) due to the production fluid pressure acting against the bottom of flapper 102. Thus, flapper valve assembly 100 automatically closes upon removal of stinger 113 from the flapper opening. Furthermore, flapper valve assembly 100 is mechanically opened by stinger 113 forcing open flapper 102 from the closed position as will be explained in more detail below.

Upper cylindrical portion 111 of pump discharge port extension assembly 110 is formed for mating cooperation with middle plug assembly 71 of bottom-hole assembly 42 as shown in FIGS. 2, 3 and 4. Upper cylindrical portion 111 includes pump discharge port, generally designated 114, having an entrance end 115 and a plurality of bottom discharge ports 116 (FIG. 4) at the lower end of pump discharge port 114. As shown in FIG. 4, the plurality of bottom discharge ports 116 are radial ports uniformly spaced around the upper cylindrical portion 111. The location of bottom discharge ports 116 along the length of upper cylindrical portion 111 is such that the bottom discharge ports 116 are positioned within the elevation of the pair of middle plug discharge ports 83 when the jet pump assembly 55 is seated in the bottom-hole assembly 42 as shown in FIGS. 2 and 3. In the preferred embodiment, the plurality of bottom discharge ports 116 ensures that at least two ports will be in fluid communication with middle plug discharge ports 83 irrespective of the angular orientation of the jet pump assembly 55 upon seating with bottom-hole assembly 42.

Referring to FIGS. 3 and 5, at least one extension upper seal 117 is preferably situated between an exterior surface 118 of upper cylindrical portion 111 and an interior sealing bore surface 119 of middle plug assembly 71. Extension upper seal 117, preferably a teflon seal, is located above the plurality of bottom discharge ports 116 and forms a fluid-tight seal separating vertical cavity 45 from the pair of discharge ports 83 in middle plug assembly 71. Interior sealing bore surface 119 has a diameter sufficient to compress extension upper seal 117 to form a fluid-tight seal between upper cylindrical portion 111 and interior sealing bore surface 119.

Preferably, at least one extension lower seal 120 is situated between exterior surface 118 of upper cylindrical portion 111 and interior sealing bore surface 119 of middle plug assembly 71. Extension lower seal 120, preferably a teflon seal, is located below the plurality of bottom discharge ports 116 and forms a fluid-tight seal separating the pair of discharge ports 83 from flapper valve bore 103. The lower extension seal 120 is compressed between upper cylindrical portion 111 and interior sealing bore surface 119.

Hence, as upper cylindrical portion 111 slides into longitudinal port 82 of middle plug assembly 71, extension upper and lower seals 117 and 120, retained in annular grooves in upper cylindrical portion 111, slidably engage interior sealing bore surface 119 forming fluid-tight seals therebetween. It will be understood that a multiple or series of side-by-side extension upper or lower seals 117 and 120 could be included without departing from the true spirit and nature of the present invention.

When jet pump assembly 55 is operationally seated, discharge of exhausted power and production fluid from the jet pump assembly 55 passes through the pair of discharge ports 83 and into either a well annulus formed between production tubing 37 and bottom-hole assembly 42 (when directly inserted in the well casing (not shown)), or a discharge annulus formed between a gas lift column 65 (FIG. 2) and bottom-hole assembly 42 (to be described in greater detail below).

In the preferred form of the present invention, the bottom-hole assembly 42 is mounted to the distal end of coiled tubing 40. Briefly, coiled tubing 40, well known in the field, is capable of being stored on a large portable spool which permits unwinding of a single, continuous length of tubing without requiring the assembly of jointed units. It will be appreciated, however, that the bottom-hole assembly 42 and "free" jet pump assembly 55 of the present invention may be coupled to and installed through jointed tubes without departing from the true spirit and nature of the present invention.

One important benefit of the present invention is that the seal and bottom hole arrangement enables the construction of small diameter bottom-hole assemblies, "free" jet pump assemblies and associated coiled tubes which are capable of being inserted into or retrofit with existing well installations, such as gas lift tubes. As best illustrated in FIG. 2, gas lifting assemblies 63, having gas lift mandrels 64, can be used for de-watering economically and efficiently by simply inserting the small diameter hydraulic jet pump apparatus 55 of the present invention (via unwinding the coiled tube 40) into the gas lift column 65 to hydraulically pump the undesirable production fluids from the well column. Hence, the gas lifting installation can be de-watered by pumping rather than employing the costly nitrogen gas discharge technique. Moreover, de-watering can be accomplished without, removal of the gas lifting assembly to employ a hydraulic pump.

Briefly, coiled tube 40 having bottom-hole assembly 42 mounted on the end thereof is unwound in gas lift tube 65 to the proper depth, or to mount to a packer device 66 or the like as shown in FIG. 2. It will be appreciated that when packers are not employed, discharge ports 83 may be communicably coupled to a return line (not shown) which extends to the top surface for production fluid recovery.

After installment of the bottom-hole assembly 42 and the tubing 40, jet pump assembly 55 is passed through tube passageway 41 for operational mating with bottom-hole assembly 42. Jet pump assembly 55 can be allowed to "free fall" from the surface or can be additionally forced by pumping power fluid behind jet pump assembly 55.

Prior to the mating of jet pump assembly 55 with bottom-hole assembly 42, flapper valve 101 is in its closed position as shown in FIG. 5. A spring (not shown) biases the flapper 102 to the closed position and the well pressure of the production fluid seals the flapper 102 in the closed position. During the installation of jet pump assembly 55 for operation, the preferably cylindrical-shaped pump body 56 with lowermost extending pump discharge port extension assembly 110 is funneled into the bottom-hole assembly sealing bore portion 47 formed and dimensioned for sliding receipt of the exterior surface of pump body 56. As pump body 56 enters vertical cavity 45, the pump annulus 88 is formed between outer tubular member 44 of bottom-hole assembly 42 and the pump body exterior surface since a transverse cross-sectional dimension of vertical cavity 45 is larger than a transverse cross-sectional dimension of passageway 41 or sealing bore portion 47.

Stinger 113 first enters the bottom-hole assembly 42. The reduced diameter of pump discharge port extension assembly 110 permits it to unobstructedly pass through adapter housing 43 and outer tubular member 44. Tapered shoulder midportion 112 of pump discharge port extension assembly 110 aligns the upper cylindrical portion 111 for entry into longitudinal port 82 of middle plug assembly 71. Tapered shoulder portion 75 of adapter housing 43 also serves to align pump body 56 as it passes. Power fluid pressure from the surface forces jet pump assembly 55 to seat in bottom-hole assembly 42 with fluid-tight seals being formed by upper O-ring seal 74 and extension upper and lower seals 117 and 120, respectively. Power fluid pressure is also used to push jet pump assembly 55 so that stinger 113 forces open flapper 102.

During operation as jet pump assembly 55 forces the power fluid through jet pump body 56 and out the pair of discharge ports 83, the production fluid is drawn into bottom-hole assembly 42 through standing valve 50, where it passes through flapper valve bore 103 to the pair of suction ports 84 of middle plug assembly 71 and into pump annulus 88 (FIGS. 2, 3 and 4). As the pressurized power fluid is forced through a jet pump nozzle 130, it intermixes with the production fluid entering and drawn into jet pump body 56 through intake entrances 73 communicating with pump annulus 88. These mixed fluids then pass through a diffuser 131 to the pump extension discharge port 114 before exiting through the pair of discharge ports 83 of bottom-hole assembly 42 and then up to the surface through a return annulus 70.

Referring to FIG. 2, the jet pump assembly 55 is retrieved to the surface by pumping power fluid down the return annulus 70. The power fluid enters the bottom-hole assembly 42 through the discharge ports 83. The power fluid then travels into and up the pump extension discharge port 114. The pressurized power fluid is then forced up through the diffuser 131 causing a resultant upward force on jet pump assembly 55. The power fluid then travels out of intake entrances 73, down pump annulus 88, and through suction ports 84. The power fluid forces valve ball 87 to seat in standing valve 56. The pressurized power fluid acts against downwardly-facing surfaces 112 and 121 of stinger 113 forcing the jet pump assembly 55 upwards.

In the situation of a catastrophic event severing the production production tubing 37, gas lift tube 65 and elongated tube 40 at a location above bottom-hole assembly 42, the resulting loss of power fluid pressure to the jet pump assembly 55 would permit jet pump assembly 55 to be unseated in bottom-hole assembly 42 due to the well production fluid pressure acting against the downwardly-facing surfaces 112 and 121 of stinger 113. As the jet pump assembly 55 is forced upwardly, the spring-loaded flapper 102 of flapper valve 101 returns to its closed position and the production fluid pressure is sealed from further release into the environment.

The present invention has been described in terms of particular embodiments. Obviously, modifications and alterations to these embodiments will be apparent to those skilled in the art in view of this disclosure. It is, therefore, intended that all such equivalent modifications and variations fall within the spirit and scope of the present invention as claimed.

What is claimed is:

1. A hydraulic pump apparatus for a well assembly including a rigid, elongated tubular casing extending into a formation producing production fluid, the hydraulic pump apparatus comprising:

an elongated tube;

a retrievable bottom-hole assembly mounted proximate a lower end of said elongated tube, said elongated tube and said bottom-hole assembly both being adapted for selective insertion into the tubular casing, said bottom-hole assembly comprising:

an upper bottom-hole assembly having an upper bore therethrough;

a middle bottom-hole assembly having a middle longitudinal bore therethrough, a fluid longitudinal port therethrough and a radial discharge port; and a lower bottom-hole assembly having a lower bore and a safety valve therein, said safety valve having a closed position which blocks said lower bore below said safety valve from said middle longitudinal bore and said fluid longitudinal port, wherein said lower bottom-hole assembly is connected to said middle bottom-hole assembly and said middle bottom-hole assembly is connected to said upper bottom-hole assembly; and a free pump assembly formed for sliding receipt in said elongated tube, said free pump assembly comprising:

an upper pump body formed for sliding receipt in said upper bottom-hole assembly; and a lower extension assembly connected to said upper pump body, said lower extension assembly having a first portion and a second portion, said first portion formed to open said safety valve upon seating of said free pump assembly in said bottom-hole assembly, and said second portion having an extension discharge port formed to be in fluid communication with said radial discharge port of said middle bottom-hole assembly upon seating of said free pump assembly in said bottom-hole assembly, said lower extension assembly further comprising:

a first seal below said extension discharge port; and a second seal above said extension discharge port, wherein said first and second seals form fluid tight seals between said lower extension assembly and said bottom-hole assembly when said free pump assembly is seated in said bottom-hole assembly.

2. The hydraulic pump apparatus according to claim 1, wherein said safety valve is a flapper valve.

3. The hydraulic pump apparatus according to claim 1, wherein said first and second seals are on said second portion and form seals with said middle bottom-hole assembly.

4. The hydraulic pump apparatus according to claim 3, wherein said discharge port intersects with said middle longitudinal bore in said middle bottom-hole assembly and said sealing engagement of said first seal forms a fluid-tight seal of said discharge port from said lower bore.

5. The hydraulic pump apparatus according to claim 4, wherein said sealing engagement of said second seal forms a fluid-tight seal of said discharge port from said upper bore.

6. The hydraulic pump apparatus according to claim 1, wherein said fluid longitudinal port in said middle bottom-hole assembly is segregated from said middle longitudinal bore and said radial discharge port.

7. The hydraulic pump apparatus according to claim 6, wherein said fluid longitudinal port provides fluid communication between said lower bore and said upper bore when said free pump assembly is seated in said bottom-hole assembly.

8. A downhole hydraulic pump apparatus for a well assembly, the downhole hydraulic pump apparatus comprising:

a retrievable bottom-hole assembly adapted for lowering within the well assembly, said bottom-hole assembly comprising:

an upper assembly having an upper bore therethrough;

a middle assembly having a middle longitudinal bore therethrough, a fluid longitudinal port therethrough and a radial discharge port; and a lower assembly having a lower bore and a safety valve therein, said safety valve having a closed position which blocks said lower bore below said safety valve from said middle longitudinal bore and said fluid longitudinal port, wherein said lower assembly is connected to said middle assembly and said middle assembly is connected to said upper assembly; and a free pump assembly comprising:

an upper pump body formed for sliding receipt in said upper assembly; and a lower extension assembly connected to said upper pump body, said lower extension assembly having a first portion and a second portion, said first portion formed to open said safety valve upon seating of said free pump assembly in said bottom-hole assembly, and said second portion having an extension discharge port formed to be in fluid communication with said radial discharge port of said middle assembly upon seating of said free pump assembly in said bottom-hole assembly, said lower extension assembly further comprising:

a first seal below said extension discharge port; and a second seal above said extension discharge port, wherein said first and second seals form fluid tight seals between said lower extension assembly and said bottom-hole assembly when said free pump assembly is seated in said bottom-hole assembly.

9. The hydraulic pump apparatus according to claim 8, wherein said safety valve is a flapper valve.

10. The hydraulic pump apparatus according to claim 8, wherein said first and second seals are on said second portion and form seals with said middle assembly.

11. The hydraulic pump apparatus according to claim 10, wherein said discharge port intersects with said middle longitudinal bore in said middle assembly and said sealing engagement of said first seal forms a fluid-tight seal of said discharge port from said lower bore.

12. The hydraulic pump apparatus according to claim 11, wherein said sealing engagement of said second seal forms a fluid-tight seal of said discharge port from said upper bore.

13. The hydraulic pump apparatus according to claim 8, wherein said fluid longitudinal port in said middle assembly segregated from said middle longitudinal bore and said radial discharge port.

14. The hydraulic pump apparatus according to claim 13, wherein said fluid longitudinal port provides fluid communication between said lower bore and said upper bore when said free pump assembly is seated in said bottom-hole assembly.

* * * * *